US006413123B1

(12) United States Patent
Kirkendall

(10) Patent No.: US 6,413,123 B1
(45) Date of Patent: Jul. 2, 2002

(54) ELECTRICAL CONNECTOR FOR SOLENOIDS ON VEHICLE TRANSMISSIONS

(75) Inventor: W. Scott Kirkendall, Laurinburg, NC (US)

(73) Assignee: Rostra Precision Controls, Inc., Laurinburg, NC (US)

( * ) Notice: Subject to any disclaimer, the term of this patent is extended or adjusted under 35 U.S.C. 154(b) by 0 days.

(21) Appl. No.: 09/755,585

(22) Filed: Jan. 5, 2001

Related U.S. Application Data

(62) Division of application No. 08/798,087, filed on Feb. 12, 1997, now Pat. No. 6,171,125.

(51) Int. Cl.[7] ..... H01R 13/64
(52) U.S. Cl. ..... 439/680
(58) Field of Search ..... 439/218, 677, 439/680

(56) References Cited

U.S. PATENT DOCUMENTS 3,399,374 A * 8/1968 Pauza et al. ..... 439/355
4,900,261 A * 2/1990 Gentry et al. ..... 439/353
5,161,996 A * 11/1992 Locati ..... 439/374
5,613,881 A * 3/1997 Ichida et al. ..... 439/680

* cited by examiner

*Primary Examiner*—Tulsidas Patel
(74) *Attorney, Agent, or Firm*—MacMillan, Sobanski & Todd, LLC

(57) ABSTRACT

An electrical connector for providing an electrical connection with a mating connector for control of a vehicle transmission is disclosed. The mating connector has electrical terminals. The electrical connector includes a shank, a hollow receptacle, and terminals. The hollow receptacle is at the end of the shank for receiving the shaft of a mating electrical connector. The terminals are positioned within the hollow receptacle for providing electrical contact with the terminals of a mating electrical connector. The receptacle has a first side with a first slot extending substantially across the width of the first side so that the receptacle can interlock with any one of a number of mating male connectors. The receptacle has a second side having a second slot extending substantially across the width of the second side so that the receptacle can interlock with any one of a number of mating connectors.

1 Claim, 2 Drawing Sheets

ELECTRICAL CONNECTOR FOR SOLENOIDS ON VEHICLE TRANSMISSIONS

CROSS REFERENCE TO RELATED APPLICATION

This application is a division of Ser. No. 08/798,087, filed Feb. 12, 1997, now U.S. Pat. No. 6,171,125, issued Jan. 9, 2001.

TECHNICAL FIELD

This invention relates to connectors for various electrical controls used in conjunction with vehicle transmissions, and with various control parts, such as solenoids for vehicle automatic transmissions. More particularly, this invention pertains to connectors having a generally standard or universal design so that they can be used to connect various control parts having any one of a number of connector designs or shapes.

BACKGROUND OF THE INVENTION

Automatic vehicle transmissions are routinely used in automotive and other vehicles to convert the power from an engine output shaft to a drive shaft. In general, the automatic transmission shifts the gear ratios so that the ratio of drive shaft revolutions to the engine revolutions increases at higher vehicle speeds. The automatic transmission typically operates on fluid mechanics, and therefore contains numerous fluid passageways and valves for controlling the flow of transmission fluid. The transmission is enclosed in a transmission case or housing, and has an input end and an output end. The exterior surface of the transmission case generally follows the contour of the transmission components contained within the transmission case. Different transmissions therefore have different outside contours.

The valves are typically mounted in or on a valve body within the transmission case. In order to control the transmission, various control devices must have access to the interior of the transmission or to the valve body. One particular control device is a solenoid which operates valves within the transmission. Frequently there are four or five solenoids placed either inside or on the outside of the transmission case to operate valves inside the transmission, although the number of solenoids can vary from zero to about 10. The solenoids used in the control of automatic transmissions are usually attached to the valve body or transmission housing with a bracket having attachment openings or bolt holes to allow the bracket and solenoid to be bolted to the transmission case or directly to the valve body.

The solenoids and other parts associated with the control of automatic transmissions are usually linked to a computer or other electrical control device by means of wires. Efficiency advances in the manufacture of the electrical wire connectors used for control purposes include the use of plug-in connectors to electrically connect one set of control wires to another. Such electrical connectors are typically made of a plastic material, such as polyethylene terephthalate or polyamides.

During the original manufacture and assembly of the motor vehicle transmission, the electrical connectors attached to such parts as solenoids have specific shapes. The original vehicle manufacturer makes sufficient quantities of any given transmission that there is essentially no cost penalty to have a unique solenoid electrical connector for each different transmission design.

One of the problems, however, with using specific connector designs is that that replacement or repair becomes difficult. Sometime during the life of most vehicles the transmission is reconditioned or rebuilt, usually by transmission specialists. Transmission rebuilders are faced with trying to find parts that duplicate the original parts in a wide variety of transmission designs. In particular, electrical connectors must be designed to fit existing connectors extending from various control devices. Suppliers of parts for this type of aftermarket have difficulty in cost-effectively making a relatively small number of parts having a particular design. Therefore, it would be advantageous if the manufacture and installation of aftermarket parts for vehicles could be made more efficiently. In particular, it would be helpful if improved electrical connectors for transmission parts such as solenoids could be developed. Such a connector would ideally reduce the number of different electrical connectors necessary for the aftermarket replacement or repair of vehicle parts.

SUMMARY OF THE INVENTION

The above objects as well as other objects not specifically enumerated are achieved by an electrical connector for providing an electrical connection with a mating connector for control of a vehicle transmission. The mating connector has electrical terminals. The electrical connector includes a shank, a hollow receptacle, and terminals. The hollow receptacle is at the end of the shank for receiving the shaft of a mating electrical connector. The terminals are positioned within the hollow receptacle for providing electrical contact with the terminals of a mating electrical connector. The receptacle has a first side with a first slot extending substantially across the width of the first side so that the receptacle can interlock with any one of a number of mating male connectors. The receptacle has a second side having a second slot extending substantially across the width of the second side so that the receptacle can interlock with any one of a number of mating connectors.

In another embodiment of the invention, the hollow receptacle of the electrical connector has a bottom side with locating ridges on the inside of the hollow receptacle so that the connector and the mating connector can be joined together in only one orientation.

In yet another embodiment of the invention, the electrical connector is combined with a solenoid for control of a vehicle transmission. The electrical connector provides an electrical connection between a mating connector of a controller and a vehicle transmission.

DETAILED DESCRIPTION AND PREFERRED EMBODIMENTS OF THE INVENTION

Figure 1:
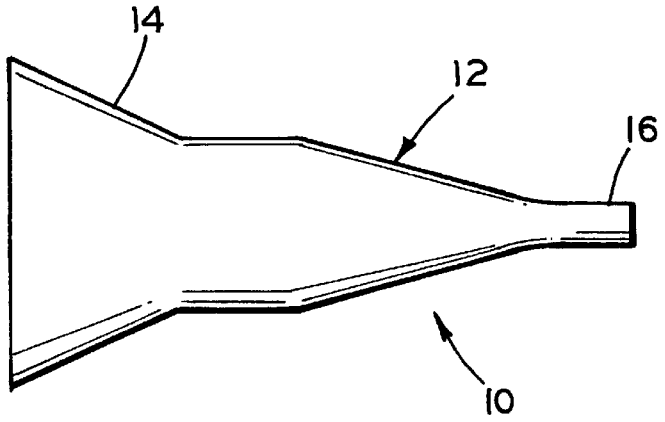
FIG. 1 is a schematic view in elevation of an automatic transmission on which the electrical connector of the invention is to be used.

As shown in FIG. 1, the transmission is indicated at 10, and is enclosed in transmission case or housing 12. The input end 14 of the transmission receives output from the vehicle engine, not shown, and after the appropriate gear reductions, the transmission delivers an output torque from output end 16 of the transmission. The control scheme illustrated in FIG. 2 includes a controller 20, which can include a computer, and which can be provided with a male connector 22 linked to the controller by lead wires 24. The transmission 10 includes a solenoid 26 mounted on the transmission valve body 27, which is within the transmission housing 12. The solenoid is linked by solenoid lead wires 28 to the female connector of the invention 30. The male connector and the female connector are designed to be snapped together to form a secure electrical connection. When the shaft 32 of the male connector 22 in inserted into the female connector of the invention 30 a complete control circuit from the controller to the solenoid is established.

Figure 3:
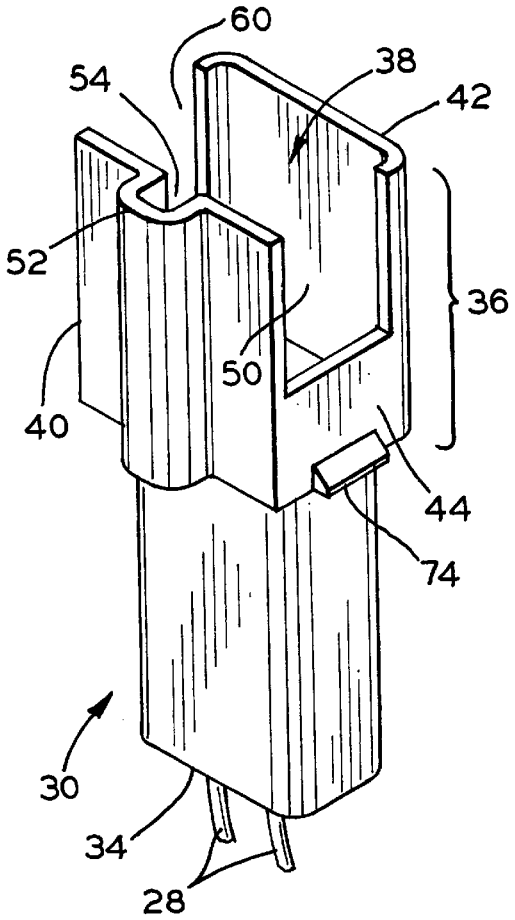
FIG. 3 is an isometric view of an electrical connector of the invention.
Figure 4:
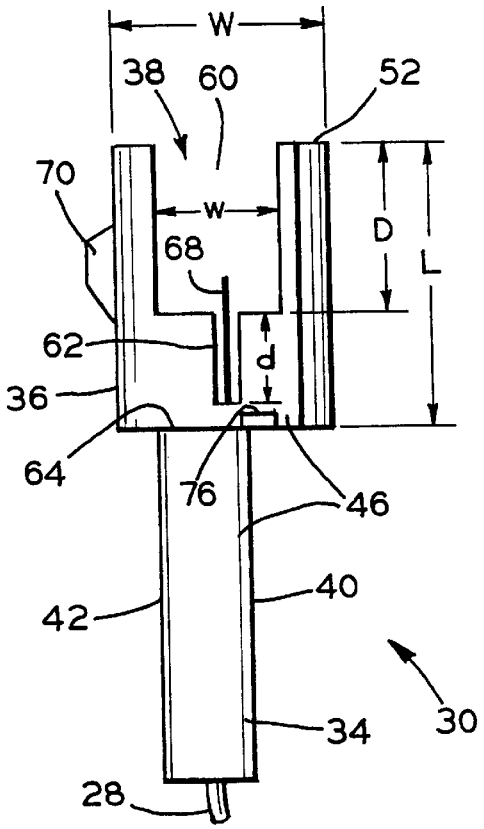
FIG. 4 is a view in elevation of the second side of the electrical connector of FIG. 3.

As shown in FIGS. 3 and 4, the electrical connector 30 of the invention includes a shank 34, and a hollow receptacle 36 having a cavity 38. The connector 30 can be viewed as having a top side 40, a bottom side 42, a first side 44 and a second side 46, which together define the cavity 38. The cavity is configured to accept or receive the male connector 22, and is generally rectangular in cross-section. Cross-sections of other shapes can also be used as long as there is compatibility with the shape of the all of the male connectors with which the connector 30 must be compatible.

As shown in FIG. 3, the first side of the connector includes a first opening or slot 50. This slot 50 enables a male connector having projections outside the dimensions of the cavity 36 to be inserted into the cavity, with the projections extending through the slot 50. The cavity extends generally the entire length L of the hollow receptacle 36, although it could be shorter in different embodiments of the invention.

Figure 2:
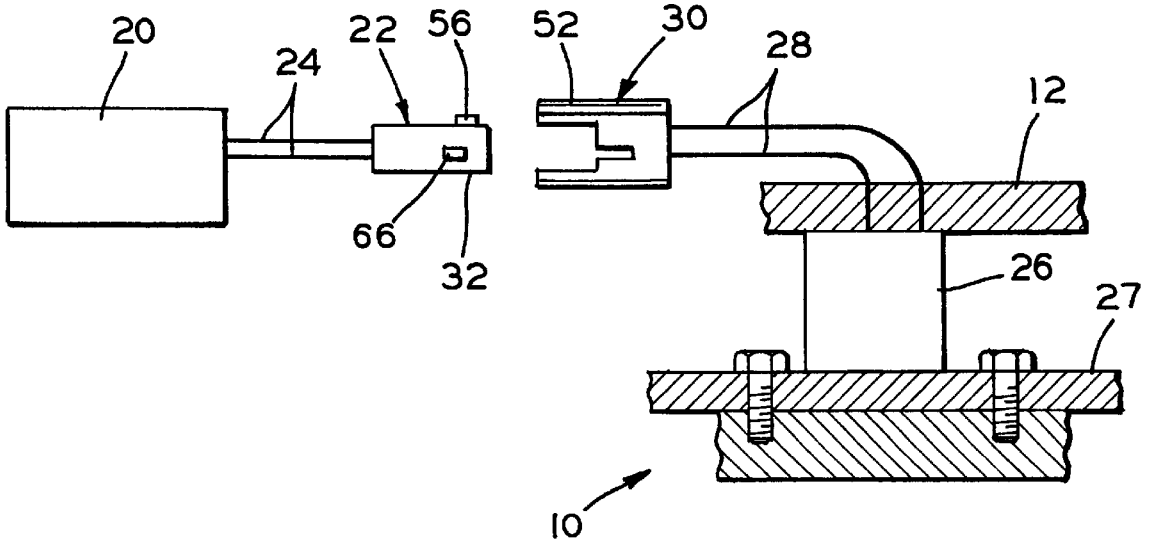
FIG. 2 is a schematic view in elevation of a control scheme using the connector of the invention.

The top side 40 of the connector 30 includes a keyway 52 having a key slot 54 for receiving a projection or an orientation spur 56, shown in FIG. 2, on the male connector 22. The use of the keyway on the female connector 30 and the spur on the male connector assures that the male and female connectors will be joined or snapped together in the correct orientation, and prevents interlocking in the wrong orientation, i.e., with one of the connectors upside down with respect to each other.

As shown in FIG. 4, the second side 46 of the connector 30 has a wide second slot 60 having a width w which is substantially the width W of second side of the connector. Preferably the slot width w is within the range of from about 75 percent to about 95 percent of the width W of the second side 46 of the connector. This width w is sufficient to provide compatibility with any one of a number of male mating connectors. In a similar manner, the first slot 50 has a width within the range of from about 75 percent to about 95 percent of the width W of the first side 44 of the connector. The second slot 60 also has a depth D that is within the range of from about 30 percent to about 70 percent of the length L of the hollow receptacle 36.

The second side 46 of the connector 36 also has an extension slot 62 extending from the second slot 60 to the bottom 64 of the hollow receptacle 36. This extension slot provides compatibility with mating male connectors having projections or spurs, such as spur 66 on the male connector 22, as shown in FIG. 2. The extension slot 62 has a depth d that is within the range of from about 10 percent to about 40 percent of the length L of the hollow receptacle 36. It can be seen from FIG. 4 that the first side slot 50 and the second side slot 60 both have approximately the same width. It is to be understood, however, that the connector 30 of the invention can be made with the first and second slots of different widths.

The electrical terminals 68 are shown as being aligned with the extension slot 62, although the electrical terminal can be out of alignment with the extension slot. The bottom side 42 of the receptacle has a spur 70 that can be used for alignment purposes with mating connectors. The connector 30 is provided with a clip 74 on the first side 44 and a clip 76 on the second side 46 for engaging detents, not shown, in the mating connector 22. This provides an interlocking or secure mechanical connection between the connector 30 of the invention and the male connector 22.

Figure 5:
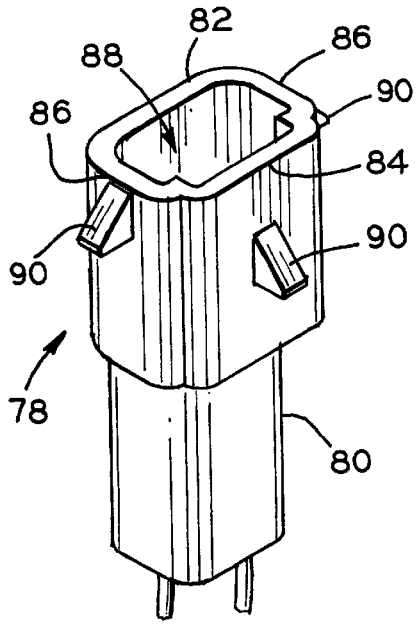
FIG. 5 is a schematic isometric view of an alternate embodiment of the electrical connector of the invention.

As shown in FIG. 5, in an alternate embodiment of the invention, the connector indicated generally at 78 has no slots through its walls. The connector 78 has a shank 80 and a hollow receptacle which is preferably generally rectangular in shape. The top wall 82, bottom wall 84 and side walls 86 define a cavity 88 into which the shaft of a mating connector can be inserted for an interlocking fit. The hollow receptacle can be provided with spurs 90 to provide positive orientation with key slots of mating connectors.

Figure 6:
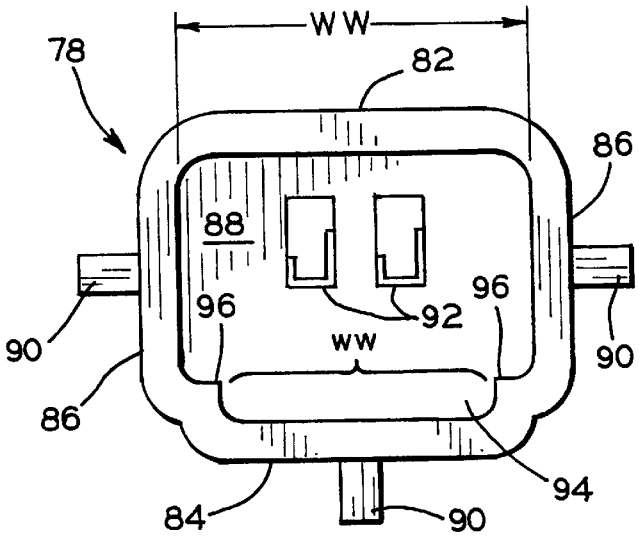
FIG. 6 is plan view of the end of the connector of FIG. 5.

As shown in FIG. 6, the connector contains terminals 92 for electrical connection with the mating connector. The cavity 88 is generally rectangular in cross-section, but has a recessed area 94 formed in the bottom wall 84. The recessed area 94 is defined by two inwardly directed projections or locating ridges 96. These locating ridges form the cross-sectional shape of the cavity 88 into an asymmetrical shape, thereby assuring that the connector 78 and a mating connector can be joined together in only one orientation. The recessed area 94 is purposely made wide to accommodate a variety of projections from any one of a number of mating conductors. Preferably the width ww of the slot 94 is within the range of from about 75 to about 95 percent of the width WW of the cavity 88.

The principle and mode of operation of this invention have been described in its preferred embodiment. However, it should be noted that this invention may be practiced otherwise than as specifically illustrated and described without departing from its scope.

What is claimed is:

1. An electrical connector comprising:

a shank;

a hollow receptacle provided on said shank, said hollow receptacle including first, second, third, and fourth walls that define a cavity having a width and a depth, said first and third walls being disposed opposite one another, said second and fourth walls being disposed opposite one another ,said first and third walls defining a first dimension that is greater than a second dimension that is defined by said second and fourth walls, said first wall having a recessed area formed therein that extends between a pair of inwardly extending projections defined on said first wall and that defines a width that is about 75% to about 95% of said width of said cavity and a depth that is substantially uniform and equal to said depth of said cavity; and at least one electrical terminal disposed within said hollow receptacle.

* * * * *